US007644451B1

(12) United States Patent
Ross

(10) Patent No.: US 7,644,451 B1
(45) Date of Patent: Jan. 12, 2010

(54) PEDAL OPERATED TOILET SEAT LIFTER AND RETURN

(76) Inventor: Michael Ross, 266 Duckpond Dr. South, Wantagh, NY (US) 11793

( * ) Notice: Subject to any disclaimer, the term of this patent is extended or adjusted under 35 U.S.C. 154(b) by 437 days.

(21) Appl. No.: 11/141,067

(22) Filed: May 31, 2005

(51) Int. Cl.
*A47K 13/10* (2006.01)

(52) U.S. Cl. ..... 4/246.1; 4/246.3; 4/248

(58) Field of Classification Search ..... 4/246.1–246.5, 4/248

See application file for complete search history.

(56) References Cited

U.S. PATENT DOCUMENTS

| | | | | |
|---|---|---|---|---|
| 1,276,472 | A | 8/1918 | Zeen | |
| 1,632,819 | A | 6/1927 | Chastain | |
| 2,117,663 | A | 5/1938 | Hill | |
| 2,155,548 | A | 4/1939 | Hompesch | |
| 2,705,330 | A | 4/1955 | Knudsen | |
| 3,055,016 | A * | 9/1962 | Kemp | 4/246.5 |
| 3,303,517 | A | 2/1967 | Wood et al. | |
| 4,807,307 | A | 2/1989 | Sato et al. | |
| 5,056,165 | A | 10/1991 | Wescott, Sr. | |
| 5,323,496 | A | 6/1994 | Blair | |
| 6,151,723 | A * | 11/2000 | MacAllister | 4/246.1 |
| 6,393,623 | B1 | 5/2002 | Strickland, Jr. | |
| 6,738,990 | B1 | 5/2004 | Jackson | |
| 7,254,846 | B2 * | 8/2007 | Kim | 4/246.3 |

FOREIGN PATENT DOCUMENTS

| | | |
|---|---|---|
| GB | 2.348.214 | 9/2000 |
| WO | WO88/04534 | 6/1988 |
| WO | WO2004/062453 | 7/2004 |

* cited by examiner

*Primary Examiner*—Tuan N Nguyen
(74) *Attorney, Agent, or Firm*—Joseph C. Merek; The Merek Group, Inc.

(57) ABSTRACT

An apparatus for selectively moving a toilet seat between a first and second position comprising: a base, a first pedal having a first end for receiving a downward force thereon pivotally connected to the base, a first means connected between the toilet seat and an end of the first pedal opposite the first end for moving the toilet seat from a first position to a second position, a second pedal having a first end for receiving a downward force thereon and pivotally connected at an edge opposite the first end to the first pedal, a second means connected between the second pedal and an upper end of the first moving means for moving at least one of the toilet seat from the second position to the first position and the second pedal away from the first pedal. Upon applying the downward force to the first end of the first pedal, the first pedal pivots and causes the first moving means to move the toilet seat from the first position to the second position and causes the second moving means to move the second pedal away from the first pedal. Upon applying the downward force on the first end of the second pedal, the second moving means causes the toilet seat to be moved from the second position to the first position.

18 Claims, 12 Drawing Sheets

PEDAL OPERATED TOILET SEAT LIFTER AND RETURN

BACKGROUND OF THE INVENTION

1. Field of the Invention

The present invention relates generally to toilets and, more specifically, to a manually operated device to facilitate the desired raising and lowering of a toilet seat through the application of pressure applied to actuators, preferably foot applied pressure upon pedals. The device is operated by the manual application of force to a first foot pedal attached to a base as an unbalanced lever to elevate a lifting member upwardly until the toilet seat is set to a stable open position. Returning the seat to its original position is achieved by depressing a second pedal flexibly attached to the first foot pedal. This action applies tension to a return linkage to displace the toilet seat to its original starting position. An adjustable dampener, typically embodied by a tensioned spring, is attached under the first foot pedal to prevent the toilet seat from abruptly being replaced on a lid of the toilet bowl.

2. Description of the Prior Art

There are other toilet devices designed for lifting a toilet seat. Typical of these is U.S. Pat. No. 1,276,472 issued to Zeen on Aug. 20, 1918.

Another patent was issued to Chastain on Jun. 21, 1927 as U.S. Pat. No. 1,632,819 Yet another U.S. Pat. No. 2,117,663 was issued to Hill on May 17, 1938 and still yet another was issued on Apr. 25, 1939, to Hompesch as U.S. Pat. No. 2,155,548.

Another patent was issued to Knudsen on Apr. 5, 1955 as U.S. Pat. No. 2,705,330. Yet another U.S. Pat. No. 3,303,517 was issued to Wood et al. on Feb. 14, 1967. Another was issued to Sato et al. on Feb. 28, 1989 as U.S. Pat. No. 4,807,307 and still yet another was issued on Oct. 15, 1991 to Wescott as U.S. Pat. No. 5,056,165.

Another patent was issued to Blair on Jun. 28, 1994 as U.S. Pat. No. 5,323,496. Yet another U.S. Pat. No. 6,393,623 was issued to Strickland on May 28, 2002. Another was issued to Jackson on May 25, 2004 as U.S. Pat. No. 6,738,990 and still yet another was issued on Mar. 26, 1999 to Moss as U.K Patent No. GB 2,348,214.

Another patent was issued to the perfect gentleman PTY.LTD on Jun. 30, 1998 as PCT No. WO88/04534. Yet another PCT No. WO2004/062453 was issued to Benyahia on Dec. 10, 2002.

U.S. Pat. No. 1,276,472

Inventor: M. Zeen

Issued: Aug. 20, 1918

A device of the character described: a swingable member having a continuous deflected slideway: a moveable element having one end swingably mounted and having its other end slideable in the slideway to one position wherein said element adapted to be moved to swing said member in one direction and to another position wherein said element is adapted to be moved to swing said member in the opposite direction.

U.S. Pat. No. 1,632,819

Inventor: W. E. Chastain

Issued: Jun. 21, 1927

In a seat actuating means for sanitary closets, in combination with a seat of a sanitary closet, an arm pivotably connected to the closet near the hinged point thereof, the opposite end pivotably connected to the arm of a bell crank, a bell crank pivotably attached to the floor by the side of the closet, a pedal engaging with the opposite end of the bell crank, to that the end thereof will reciprocate on each side of the fulcrum of the crank a slotted tube attached to the pivotal so that one arm of the bell crank will engage in the slot, a recoil spring positioned in the tube to function as a cushion for the bell crank, adjustable supporting means for the spring longitudinally in the tube, all as and for the purpose described.

U.S. Pat. No. 2,117,663

Inventor: T. F. Hill

Issued: May 17, 1938

In combination with a lavatory house having a door, a bowl having a seat cover, means between the door and the seat cover for elevating the seat cover as the door is opened, and detent means for holding the seat in the uncovered position when the door is substantially closed.

U.S. Pat. No. 2,155,548

Inventor: G. Hompesch

Issued: Apr. 25, 1939

In combination with a toilet having a seat and cover hingedly mounted thereon, means for limiting the upward movement of said seat and cover, a lever extending upwardly pivotally mounted, intermediate in its length on said toilet seat. One end of said lever extends above said toilet seat when the same is in its closed position. A lever having one end pivotally connected to said toilet cover forward of the pivot point of said first mentioned lever on the toilet seat and having the other end pivotally connected to the upwardly extended lever. A foot lever pivotally mounted at the base of said toilet, and pivotally connected to one end of said foot lever and extending upwardly the other end of said rod being connected to said upwardly extending lever, the connection between said upwardly extending lever and said rod being forward of the pivotal connection between said rod and foot lever.

U.S. Pat. No. 2,705,330

Inventor: R. R. Knudsen

Issued: Apr. 5, 1955

In a water closet having a seat hinged to swing in a vertical direction about a horizontal axis, a cover hinged to swing in a vertical direction about the same axis and adapted to rest upon and move with said seat when both are in their lowered position, said cover and seat being movable from said lowered position to a raised position slightly past vertical, the combination of a housing mounted at the rear of the water closet, a foot actuated means mounted on the housing to move between limits a gear train in said housing driven by said means, a lifter arm journalled on said housing and driven by said means to contact said seat and move said seat from its raised position, said arms moving towards each other in directions to engage said seat when actuation of said foot means is sustained.

U.S. Pat. No. 3,303,517

Inventor: C. M. Wood et al.

Issued: Feb. 14, 1967

In a seat lifter mechanism for a toilet bowl having a seat pivoted to the bowl by a lug extending through a section of the bowl, said mechanism comprising foot actuated linkage means for lifting the seat upwardly about its pivotal axis, means mounting said linkage means for supporting the same, and means on said mounting means for attaching the lifter mechanism to the seat lug, and means on said plate-like member for adjusting the position of the member with respect to the toilet bowl when in coupled relationship to the seat lug.

U.S. Pat. No. 4,807,307

Inventor: Toru Sato

Issued: Feb. 28, 1989

A device for opening and closing the seating plate of the lavatory unit of the seat type wherein the unit is provided with only the seating plate. The device includes a spring for connecting a movable member attached to the unit body with the seating plate freely swingably pivoted on the unit body at one end rim thereof, an opening mechanism for moving the movable member to reverse the urging direction of the spring from its seating-plate-closing direction to its seating-plate-opening direction, and a closing mechanism for causing the seating plate to be closed. When the opening mechanism is made operative, the urging direction of the spring is reversed to open the seating plate. When the unit is provided with the seating and the cover plate, the device includes a pair of springs for connecting a pair of movable members attached to the unit body with the seating and the cover plate, which movable members are freely swingably pivoted on the unit body at one end thereof, a pair of opening mechanisms for moving each of the movable members to reverse the urging direction of each spring from its seating- or cover-plate-closing direction to its seating- or cover-plate-opening direction, an interlocking mechanism for interlocking the cover-plate-opening with the seating-plate-opening mechanism, and a closing mechanism for causing the cover plate to be closed. The cover plate is thus similarly opened by the urging action of the spring and when the seating plate is opened, the cover-plate-opening mechanism is interlocked with this seating-plate-opening action to open the cover plate.

U.S. Pat. No. 5,056,165

Inventor: Reginald E. Wescott

Issued: Oct. 15, 1991

An apparatus including a conduit arrangement directing linkage to individually and selectively lift a toilet seat in cooperation with a flush lever of a commode organization to minimize manual contact with the commode apparatus.

U.S. Pat. No. 5,323,496

Inventor: Stephen F. Blair

Issued: Jun. 28, 1994

A toilet seat lifting apparatus comprising two side-by-side pivotally connected flat members, a first member having two spaced holes for alignment with seat attachment holes in a rear portion of a toilet bowl, and a second member extending from the first member in a forward direction toward the front of the toilet bowl having a projection at its forward end for engagement with a toilet seat. The second member further includes a lever extending rearwardly past the first member. This assembly is operated by a foot operated actuating member mounted adjacent to a side of the toilet bowl with a connection between the lever and the actuating member. Upon installation of the members beneath a toilet seat, operation of the actuating member pulls the lever down and forward, causing the second member to pivot up to lift the seat. This assembly further consists of a resilient restraint connected to a lower surface of the second member and above a top surface of the toilet bowl for restraining downward movement of the second member with respect to the top surface of a toilet bowl.

U.S. Pat. No. 6,393,623

Inventor: Rufus Willie Strictland

Issued: May 28, 2002

The present invention includes a floor mounted toilet with a mechanical lift device comprising an adjustable linkage assembly connected between a foot pedal and a torque arm of a torque rod. The torque rod is affixed to the toilet seat to rotate the toilet seat. Applying a pedal force raises the toilet seat to a raised seat angle. A floor mounted base member rotationally supports the foot pedal and rigidly supports a vertical member carrying a pivot plate of the linkage assembly to rotate about a pivotal axis. The initial force to raise the toilet seat is adjusted by changing the first length of an upper rod of the linkage assembly. The raised seat angle is adjusted by the second length of a lower rod of the linkage assembly. The first and second lengths are adjusted by providing length adjusting devices, such as a turnbuckle.

U.S. Pat. No. 6,738,990

Inventor: Michael Jackson

Issued: May 25, 2004

A toilet seat lifting device for attachment to a toilet for allowing a user to raise and lower a toilet seat without having to manually touch the seat. The toilet seat lifting device has a frame situated alongside the side of the toilet bowl base. The toilet seat lifting device also has a pedal, a lift arm, and a pulley assembly having a cord connecting the pedal and the lift arm. The lift arm has a forward end, a rearward end, and a middle portion, the forward end secured to the underside of the toilet seat. The cord is attached to the lift arm rear portion. Pressing the pedal downward causes the pulley assembly to pivot the rear portion of the lift arm downward, thereby raising the toilet seat.

U.K. Patent Number GB2,348,214

Inventor: Ronnen Moss

Issued: Mar. 26, 1999

A lifting/lowering device for a toilet seat (A) comprises a plate (H) that connects the seat to the toilet bowl and a mechanical linkage that connects the plate to a foot pedal (E). When the pedal is depressed, the mechanical linkage acts on the plate to lift the seat.

International Patent Application Number WO88/04534

Inventor: The Perfect Gentleman PTY.LTD.

Issued: 30 Jun. 1988

A foot-operated toilet seat lifting device (10) comprises a substantially closed floor-mounted casing (11) having an inclined pedal (15) forming part of the upper surface of the casing and hinged to the front of the base of the casing. The pedal (15) is connected to one end of a pivotally mounted lever arm (16) within the casing, the other end of the lever arm (16) being connected to a connector rod (20) protruding upwards from the casing to the toilet seat. Depression of the pedal (15) causes the lever arm (16) to lift the connector rod (20), thereby raising the toilet seat and any cover thereon.

International Patent Application WO2004/062453

Inventor: Lahcene Benyahia

Issued: Dec. 10, 2002

The invention relates to a device which is used to lift and lower a toilet seat without the use of the hand. According to the invention, the lower face of the toilet seat comprises a hook (3b) which, when the seat is lowered, fits into an opening (14a) in a case B4 which is fixed to the front face of the toilet bowl (48). Another case, B1, is fixed to a recessed surface. An upper pedal (6a) is used to lift the toilet seat (4a) while a second pedal (6b) is used to lower same. The aforementioned two pedals actuate a cable (34) which is disposed inside the toilet bowl (48), from which it emerges through an eyelet (15) and passes through a hole (12) where it is blocked by a screw (18a). A base (8a), which is screwed to the ceramic of the bowl (48), receives a spring (9a), a toilet seat (4a) and a cover (23), said assembly pivoting on a shaft (42e).

While these toilet seat lifters may be suitable for the purposes for which they were designed, they would not be as suitable for the purposes of the present invention, as hereinafter described.

SUMMARY OF THE PRESENT INVENTION

The present invention relates generally to toilets and, more specifically, to a manually operated device to facilitate the desired raising and lowering of a toilet seat through the application of pressure applied to actuators, preferably foot applied pressure upon pedals. The device is operated by the manual application of force to a first foot pedal attached to a base as an unbalanced lever to elevate a lifting member upwardly until the toilet seat is set to a stable open position. Returning the seat to its original position is achieved by depressing a second pedal flexibly attached to the first foot pedal. This action applies tension to a return linkage to displace the toilet seat to its original starting position. Optionally, a dampener, preferably embodied by a simple mechanism such as a tensioning spring or other devices incorporating some means of adjusting, as illustrated in the drawing figures, is attached under the first foot pedal to prevent the toilet seat from abruptly being repositioned on the rim of the toilet bowl.

A primary object of the present invention is to provide a toilet seat lifting apparatus able to over come the short comings of the prior art.

Another secondary object of the present invention is to provide a toilet seat lifting apparatus operable for the lifting and resetting back down of a toilet seat by the depression of a set of pedals.

Another object of the present invention is to provide a toilet seat lifting apparatus whereby the depression of a first pedal would activate a lever action to drive a lifting member to lift a toilet seat.

Yet another object of the present invention is to provide a toilet seat lifting apparatus whereby the depression of a second pedal would cause a return linkage to pull on a toilet seat to create tensile forces to return said seat back down into place.

Still yet another object of the present invention is to provide a toilet seat lifting apparatus having an adjustable base portion that allows for the present invention to be set in position next to a toilet while simultaneously being abutted to a wall.

Another object of the present invention is to provide a toilet seat lifting apparatus having an adjustable dampener to prevent the slamming back down of a toilet seat while being retracted.

Yet another object of the present invention is to provide a toilet seat lifting apparatus having a plurality of adjustable size portions allowing it to be assimilated to any toilet.

Another object of the present invention is to provide a toilet seat lifting apparatus that is simple and easy to use.

A still further object of the present invention is to provide a toilet seat lifting apparatus that is economical in cost to manufacture.

Additional objects of the present invention will appear as the description proceeds.

The present invention overcomes the shortcomings of the prior art by providing a toilet seat lifter capable of lifting and resetting a toilet seat by the depression of a series of pedals, with a first pedal functioning to produce a lifting operation to the seat with the application of upward force to a pivotally mounted lifting member and a second pedal to apply tension to a return linkage for the seat's retraction. Additionally the present invention may be adapted to any toilet via an adjustable base and lifting member, and has an adjustable dampener in the base to prevent the slamming back down of the toilet seat.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
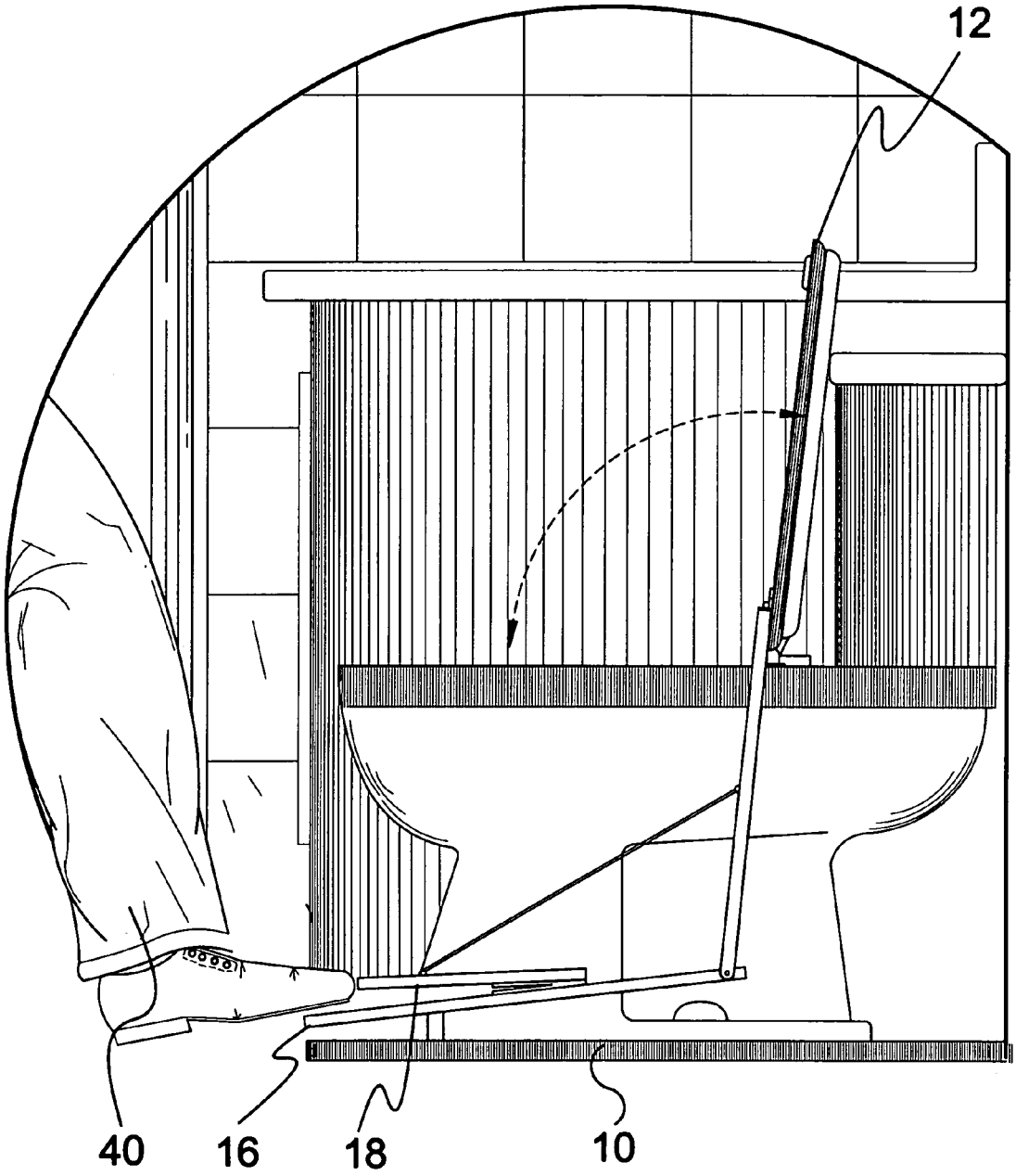
FIG. 1 is an illustrative view of the pedal operated toilet seat lifter of the present invention in use.

Turning now descriptively to the drawings, in which similar reference characters denote similar elements throughout the several views, the Figures illustrate the pedal operated toilet seat lifter of the present invention. With regard to the reference numerals used, the following numbering is used throughout the various drawing Figures.

10 pedal operated toilet seat lifter of the present invention
12 toilet seat
13 toilet seat cover
14 return linkage
16 first foot pedal
18 second foot pedal
19 hinge
20 spring dampener
22 base
23 pivot point
24 adjustable wall brace stabilizer
25 retractable member
26 telescoping member
27 connection pin
28 lifting member
30 toilet seat attachment
34 hitch pin
36 mounting screws
38 tension screw
39 track
40 user
42 raising pressure
46 dampener
48 pivotal fastener

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments; practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1-12 illustrate the pedal operated toilet seat lifter of the present invention which is indicated generally by the numeral 10.

FIG. 1 is an illustrative view of the pedal operated toilet seat lifter apparatus 10 of the present invention, hereinafter referred to as the "seat lifter apparatus," in use. The user 40 depresses one of a plurality of pedals 16 and 18 with his foot. A first foot pedal 16 is depressed to raise the toilet seat 12 from its resting position on the rim of the toilet bowl. A second foot pedal 18, connected to the first foot pedal 16 is then depressed to return the raised toilet seat 12 to its resting position on the toilet bowl. Alternatively for all figures described herein, the seat lifter apparatus 10 can also be attached to the lid of the toilet seat 12 for raising and lowering the toilet seat lid.

Figure 2:
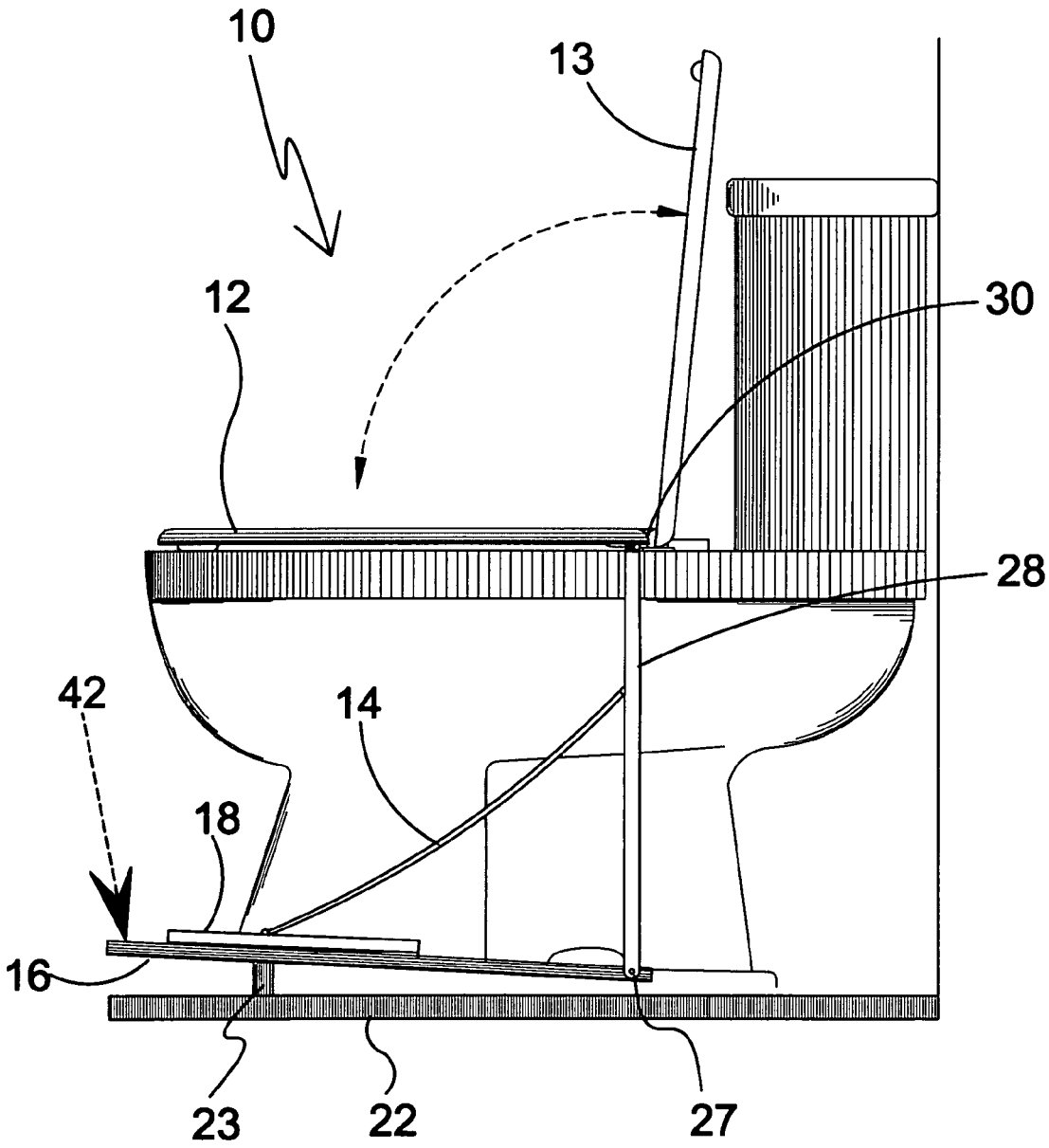
FIG. 2 is a side view of the pedal operated toilet seat lifter of the present invention in the lowered position.

FIG. 2 is a side view of the seat lifter apparatus 10 of the present invention wherein the toilet seat 12 is in the lowered position. The seat lifter apparatus 10 has a base 22 on which the apparatus 10 is anchored. The base 22 includes a pivot point 23 extending upward from a first side of the base 22. The pivot point 23 is located at a predetermined distance from a first edge of the base 22. A first foot pedal is pivotally mounted on the base 22 via the pivot point 23. A lifting member 28 extends vertically from an edge of the first foot pedal 16 opposite the first edge and is connected thereto at a first end thereof by a connection pin 27. The lifting member 28 is connected to a toilet seat 12 via a toilet seat attachment 30 at an end opposite the connection with the first foot pedal 16. In the present embodiment, the toilet seat attachment 30 is a single hinge attachment and is provided on an under side of the toilet seat adjacent to a rear edge where the toilet seat 12 is hingedly connected to the rim of the toilet bowl as shown hereinafter in FIG. 5. The hinge attachment 30 may be connected using mounting screws 36 for wooden toilet seats 12 or epoxy for plastic toilet seats 12. A hitch pin 34 shown in FIG. 8 attaches the hinge to the lifting member 28.

Figure 3:
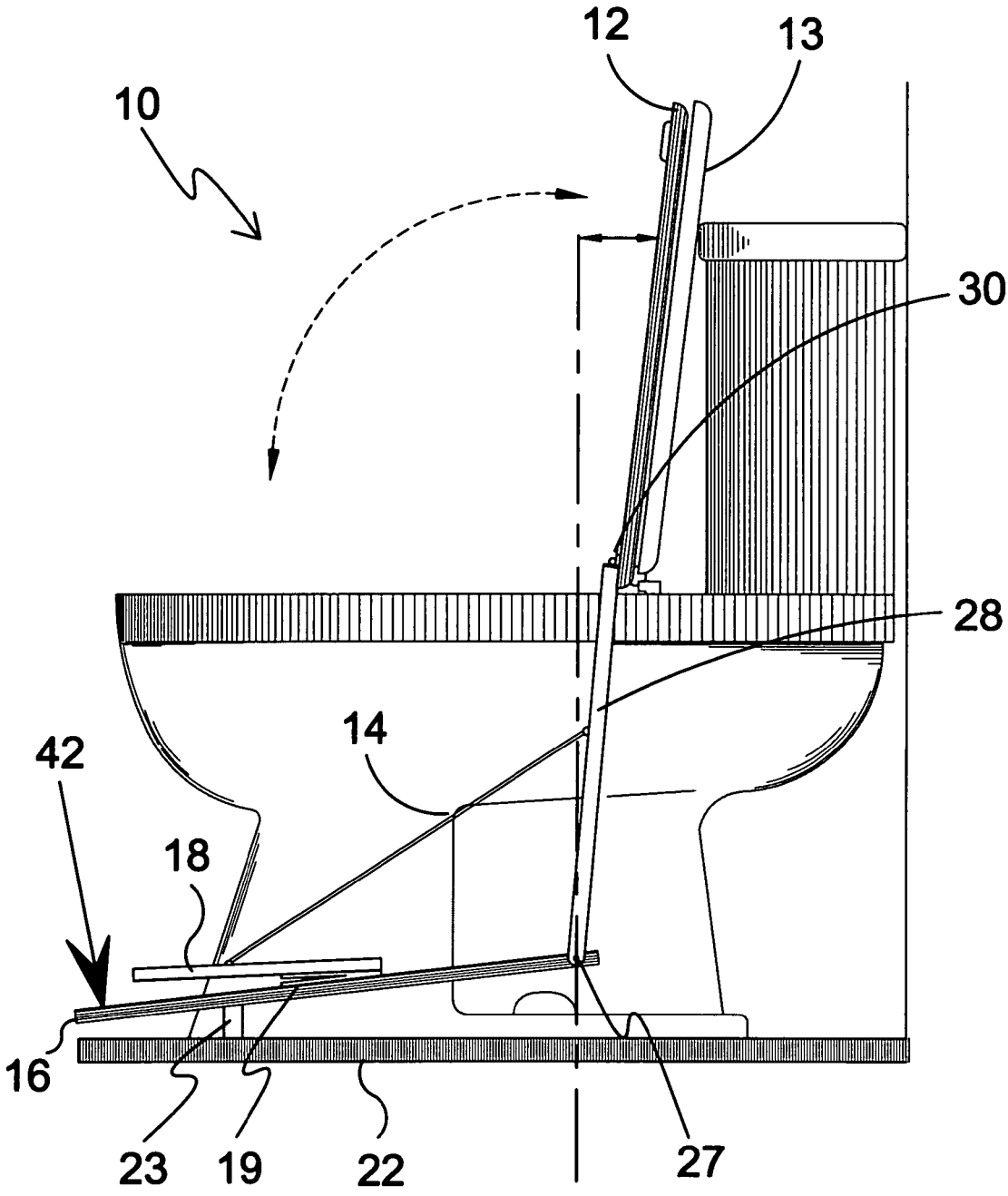
FIG. 3 is a side view of the pedal operated toilet seat lifter of the present invention in the raised position.

A second foot pedal 18 is mounted on the first foot pedal 16 via hinge 19 as shown in FIG. 3. A return linkage 14 is connected between a top side of the second foot pedal 18 and upper end of the lifting member 28.

The first foot pedal 16 is used for raising the toilet seat 12 by applying a raising pressure 42, while the second foot pedal 18 is used for lowering the toilet seat 12 after it has been raised.

Shown herein, the toilet seat 12 is in the lowered position. While in this position, the first foot pedal 16 and the second foot pedal 18 are adjacent with each other. Both pedals are in a neutral position as neither pedal is depressed. While in this neutral position, the lifting member 28 is substantially perpendicular to the first foot pedal 16 and the return linkage 14 is not taut.

FIG. 3 is a side view of the seat lifter apparatus 10 of the present invention wherein the toilet seat 12 is in the raised position. The seat lifter apparatus 10 has a base 22 on which the apparatus 10 is anchored. The base 22 includes a pivot point 23 extending upward from a first side of the base 22. The pivot point 23 is located at a predetermined distance from a first edge of the base 22. A first foot pedal is pivotally mounted on the base 22 via the pivot point 23. A lifting member 28 extends vertically from an edge of the first foot pedal 16 opposite the first edge and is connected thereto at a first end thereof by a connection pin 27. The lifting member 28 is connected to a toilet seat 12 via a toilet seat attachment 30 at an end opposite the connection with the first foot pedal 16. In the present embodiment, the toilet seat attachment 30 is a single hinge attachment and is provided on an under side of the toilet seat adjacent to a rear edge where the toilet seat 12 is hingedly connected to the rim of the toilet bowl as shown hereinafter in FIG. 5. The hinge attachment 30 may be connected using mounting screws 36 for wooden toilet seats 12 or epoxy for plastic toilet seats 12. A hitch pin 34 shown in FIG. 8 attaches the hinge to the lifting member 28.

A second foot pedal 18 is mounted on the first foot pedal 16 via hinge 19 as shown in FIG. 3. A return linkage 14 is connected between a top side of the second foot pedal 18 and a midpoint of the lifting member 28.

When a user desires to raise the toilet seat 12, as shown herein, the user depresses the first foot pedal 16 by applying pressure 42 thereto. The first food pedal 16 pivots about pivot point 23 causing the lifting member 28 to partially rotate about the pin 27 forming an obtuse angle between the first foot pedal 16 and lifting member 28. The first foot pedal 16 and lifting member 28 move in direction away form the base 22 and the lifting member 28 raises the toilet seat 12. In this position, the return linkage 14 is taut which causes the second foot pedal 18 to be moved away from the first side of the first foot pedal 16 to an operative position whereby pressure placed thereon causes the seat 12 to a lowered position, as will be discussed hereinafter with respect to FIG. 4.

Figure 4:
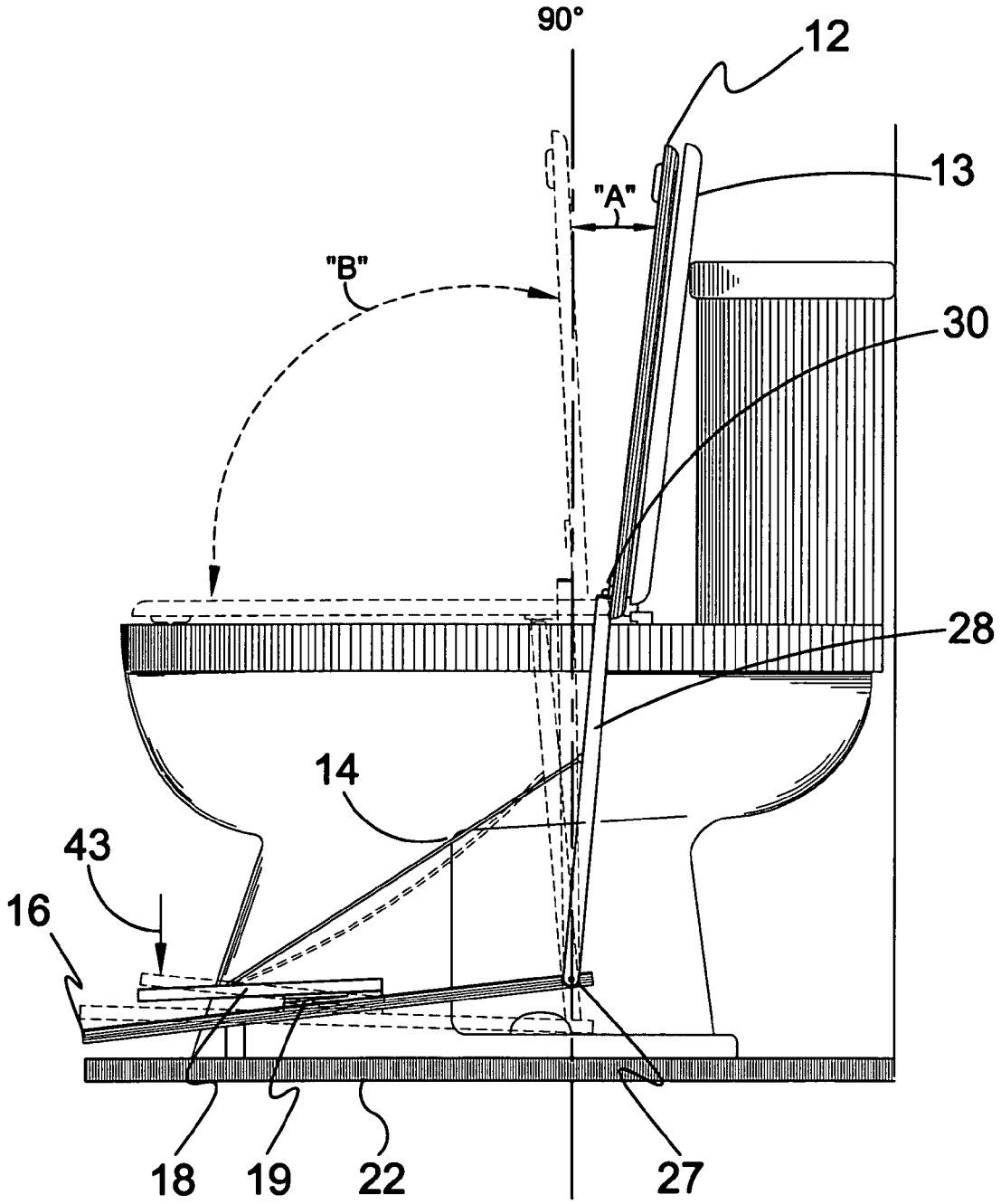
FIG. 4 is a side view of the pedal operated toilet seat lifter of the present invention with the seat in the process of being lowered.

FIG. 4 is a side view of the pedal operated toilet seat lifter of the present invention with the seat in the process of being lowered. The seat lifter apparatus 10 has a base 22 on which the apparatus 10 is anchored. The base 22 includes a pivot point 23 extending upward from a first side of the base 22. The pivot point 23 is located at a predetermined distance from a first edge of the base 22. A first foot pedal is pivotally mounted on the base 22 via the pivot point 23. A lifting member 28 extends vertically from an edge of the first foot pedal 16 opposite the first edge and is connected thereto at a first end thereof by a connection pin 27. The lifting member 28 is connected to a toilet seat 12 via a toilet seat attachment 30 at an end opposite the connection with the first foot pedal 16. In the present embodiment, the toilet seat attachment 30 is a single hinge attachment and is provided on an under side of the toilet seat adjacent to a rear edge where the toilet seat 12 is hingedly connected to the rim of the toilet bowl as shown hereinafter in FIG. 5. The hinge attachment 30 may be connected using mounting screws 36 for wooden toilet seats 12 or epoxy for plastic toilet seats 12. A hitch pin 34 shown in FIG. 8 attaches the hinge to the lifting member 28.

A second foot pedal 18 is mounted on the first foot pedal 16 via hinge 19 as shown in FIG. 3. A return linkage 14 is connected between a top side of the second foot pedal 18 and a midpoint of the lifting member 28.

Shown herein, the toilet seat 12 is in the process of being lowered. A second downward force 43 is applied to the second foot pedal 18. The application of the force 43 causes the return linkage 14 to pull the lifting member 28 from an obtuse angle represented by distance "A" and "B" to an acute angle, represented by distance "B" relative to the toilet rim whereby gravity will cause the seat to lower. The toilet seat 12 is moved to a distance greater than or equal to the distance represented by the letter "A". When the toilet seat 12 has moved away from its at rest raised position, and is positioned past "A", an angle between the seat 12 and a rim of the toilet is less than 90 degrees, as shown herein, gravity causes the seat to move the remaining distance indicated by the letter "B" and the seat 12 is returned to a fully lowered position indicated by the dotted outline of the toilet seat 12.

Figure 5:
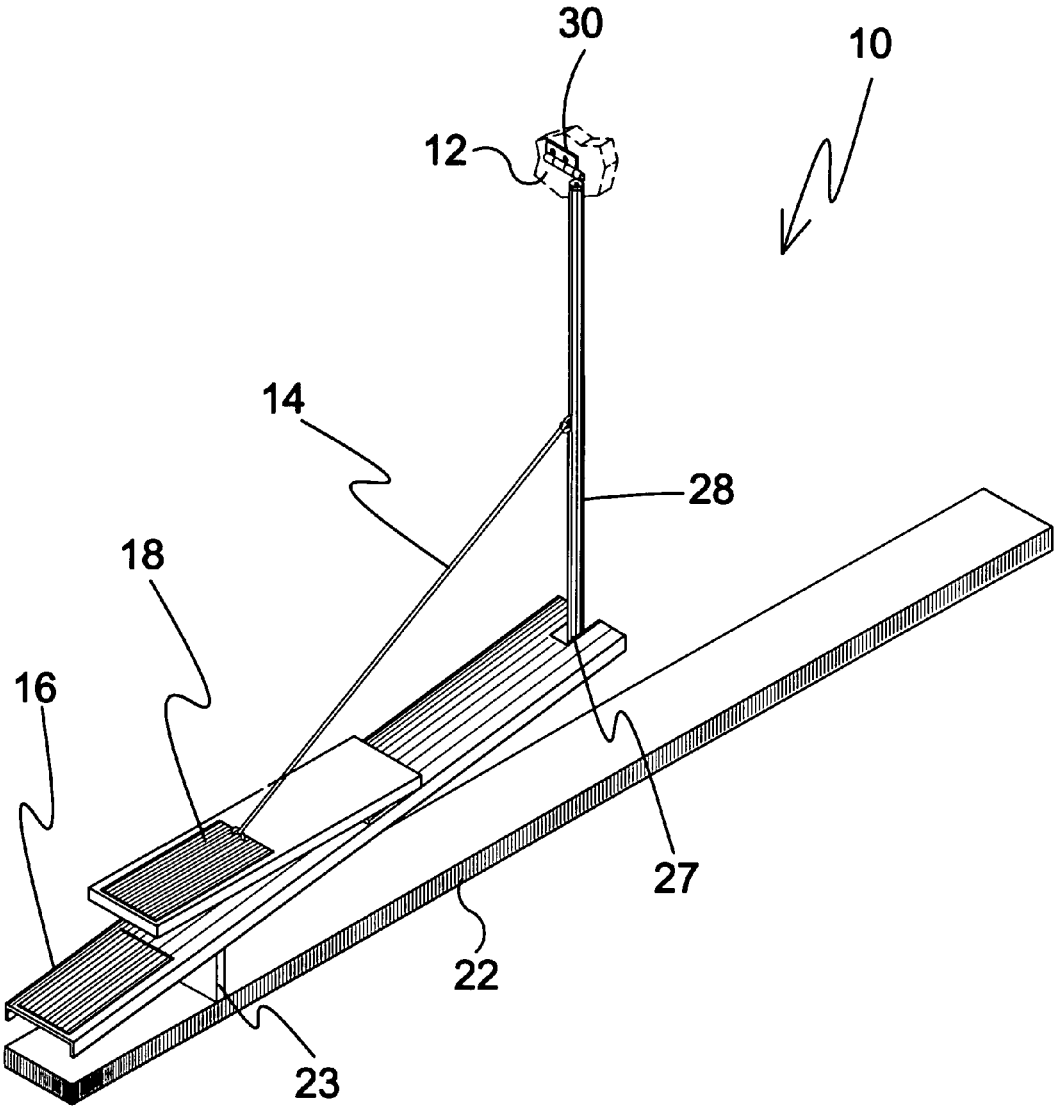
FIG. 5 is a perspective view of the pedal operated toilet seat lifter of the present invention.

FIG. 5 is a perspective view of the pedal operated toilet seat lifter of the present invention. Typically, as shown hereinabove with respect to FIGS. 1-4, the base 22 includes a pivot point 23 extending upward from a first side of the base 22. The pivot point 23 is located at a predetermined distance from a first edge of the base 22. A first foot pedal is pivotally mounted on the base 22 via the pivot point 23. A lifting member 28 extends vertically from an edge of the first foot pedal 16 opposite the first edge and is connected thereto at a first end thereof by a connection pin 27. The lifting member 28 is connected to a toilet seat 12 via a toilet seat attachment 30 at an end opposite the connection with the first foot pedal 16. In the present embodiment, the toilet seat attachment 30 is a single hinge attachment and is provided on an under side of the toilet seat adjacent to a rear edge where the toilet seat 12 is hingedly connected to the rim of the toilet bowl as shown hereinafter in FIG. 5. The hinge attachment 30 may be connected using mounting screws 36 for wooden toilet seats 12 or epoxy for plastic toilet seats 12. A hitch pin 34 shown in FIG. 8 attaches the hinge to the lifting member 28.

A second foot pedal 18 is mounted on the first foot pedal 16 via hinge 19 as shown in FIG. 3. A return linkage 14 is connected between a top side of the second foot pedal 18 and upper end of the lifting member 28.

FIG. 5 shows the first foot pedal 16 in an activated position which causes the angle between the first foot pedal and the lifting member 28 to be greater than 90 degrees. Additionally, the return linkage is taut and causes the second foot pedal 18 to be moved away from the first side of the first foot pedal 16. The hinge 19, as shown in FIG. 3 causes the second foot pedal 18 to remain apart from the first foot pedal 16. When the second foot pedal 18 is apart from the first foot pedal 16, the second foot pedal is in an activated position.

Figure 6:
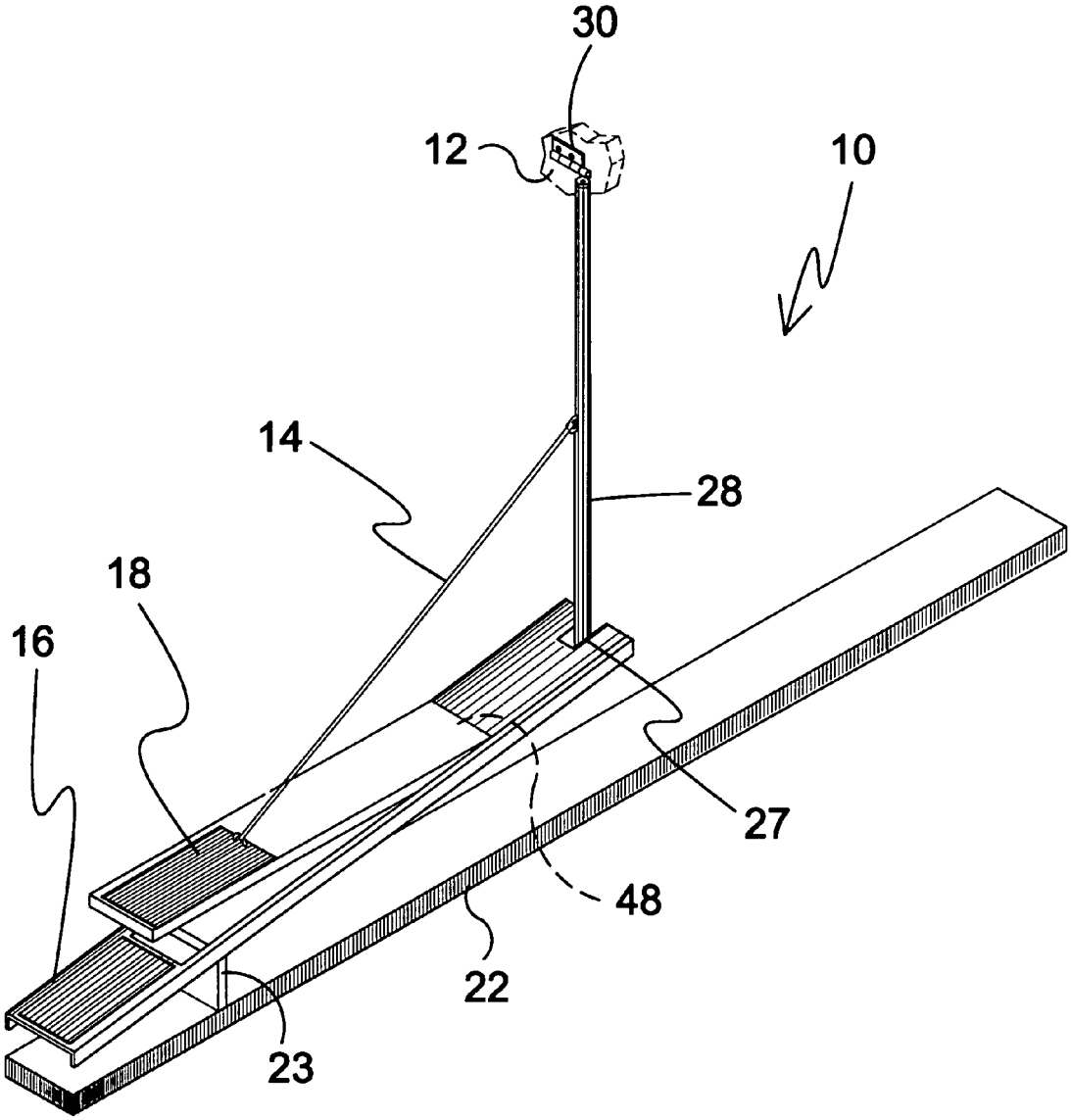
FIG. 6 is a perspective view of the pedal operated toilet seat lifter of the present invention in an alternate embodiment.

FIG. 6 is a perspective view of the pedal operated toilet seat lifter of the present invention in an alternate embodiment. Typically, as shown hereinabove with respect to FIGS. 1-4, the base 22 of the apparatus 10 includes a pivot point 23 extending upward from a first side of the base 22. The pivot point 23 is located at a predetermined distance from a first edge of the base 22. A first foot pedal is pivotally mounted on the base 22 via the pivot point 23. A second foot pedal 18, as previously described in FIGS. 1-5, is now incorporated into the body of the first foot pedal 16 having a pivotal connection 48 therewith. When the second foot pedal 18 is in the seated at rest position with the first foot pedal 16, apparatus 10 has the appearance of a single foot pedal. As aforementioned, lifting member 28 extends vertically from an edge of the first foot pedal 16 opposite the first edge and is connected thereto at a first end thereof by a connection pin 27. The lifting member 28 is connected to a toilet seat 12 via a toilet seat attachment 30 at an end opposite the connection with the first foot pedal 16.

FIG. 6 shows the first foot pedal 16 in an activated position which causes the angle between the first foot pedal and the lifting member 28 to be greater than 90 degrees. Additionally, the return linkage is taut and causes the recessed second foot pedal 18 to be moved from an at rest position to an operative position away from the first foot pedal 16 via pivotal fastener 48.

Figure 7:
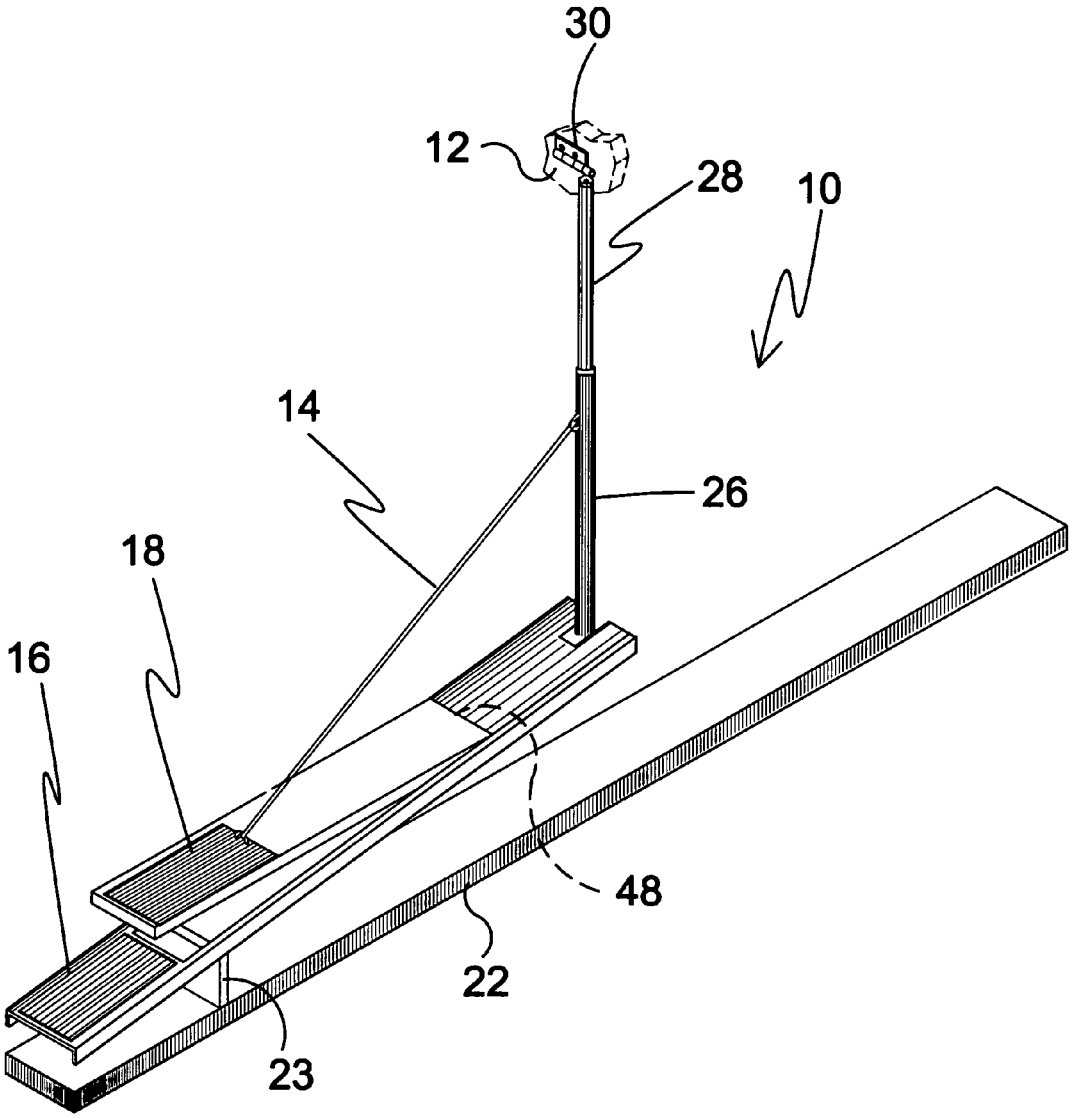
FIG. 7 is a perspective view of the foot pedals of the pedal operated toilet seat lifter of the present invention in an alternate embodiment.

FIG. 7 is a perspective view of the foot pedals of the pedal operated toilet seat lifter of the present invention in an alternate embodiment. Typically, as shown hereinabove with respect to FIGS. 1-4, the base 22 of the apparatus 10 includes a pivot point 23 extending upward from a first side of the base 22. A first foot pedal is pivotally mounted on the base 22 via the pivot point 23 with lifting member 28 extending vertically from an edge of the first foot pedal 16 opposite the first edge and is connected thereto at a first end thereof by a connection pin 27. The lifting member 28 is connected to a toilet seat 12 via a toilet seat attachment 30 at an end opposite the connection with the first foot pedal 16. In the present embodiment, the toilet seat attachment 30 is a single hinge attachment and is provided on an under side of the toilet seat adjacent to a rear edge where the toilet seat 12 is hingedly connected to the rim of the toilet bowl as shown hereinafter in FIG. 5. The hinge attachment 30 may be connected using mounting screws 36 for wooden toilet seats 12 or epoxy for plastic toilet seats 12. A hitch pin 34 shown in FIG. 8 attaches the hinge to the lifting member 28.

A second foot pedal 18 is mounted on the first foot pedal 16 via hinge 19 as shown in FIG. 3. A return linkage 14 is connected between a top side of the second foot pedal 18 and an upper point of lifting member 28.

FIG. 7 shows the first foot pedal 16 in an activated position which causes the angle between the first foot pedal and the lifting member 28 to be greater than 90 degrees. Additionally, the return linkage is taut and causes the recessed second foot pedal 18 to be moved away from the first side of the first foot pedal 16. The hinge 19, as shown in FIG. 3 causes the recessed second foot pedal 18 to remain apart from the first foot pedal 16. When the recessed second foot pedal 18 is apart from the first foot pedal 16, the second foot pedal is in an activated position.

The lifting member 28 as shown herein is preferably formed as a telescopic member. The advantage of having the lifting member 28 being formed as a telescopic member is to allow for varying the distance between the seat 12 and the connection to the first foot pedal 16. The ability to vary the aforementioned distance allows for a user to change the amount of force applied when actuated to at least one of lift the seat 12 and return the seat 12 to a resting position. Furthermore, the ability to vary the distance described above allows for the apparatus 10 to be fit to a plurality of differently shaped and sized toilets.

Figure 8:
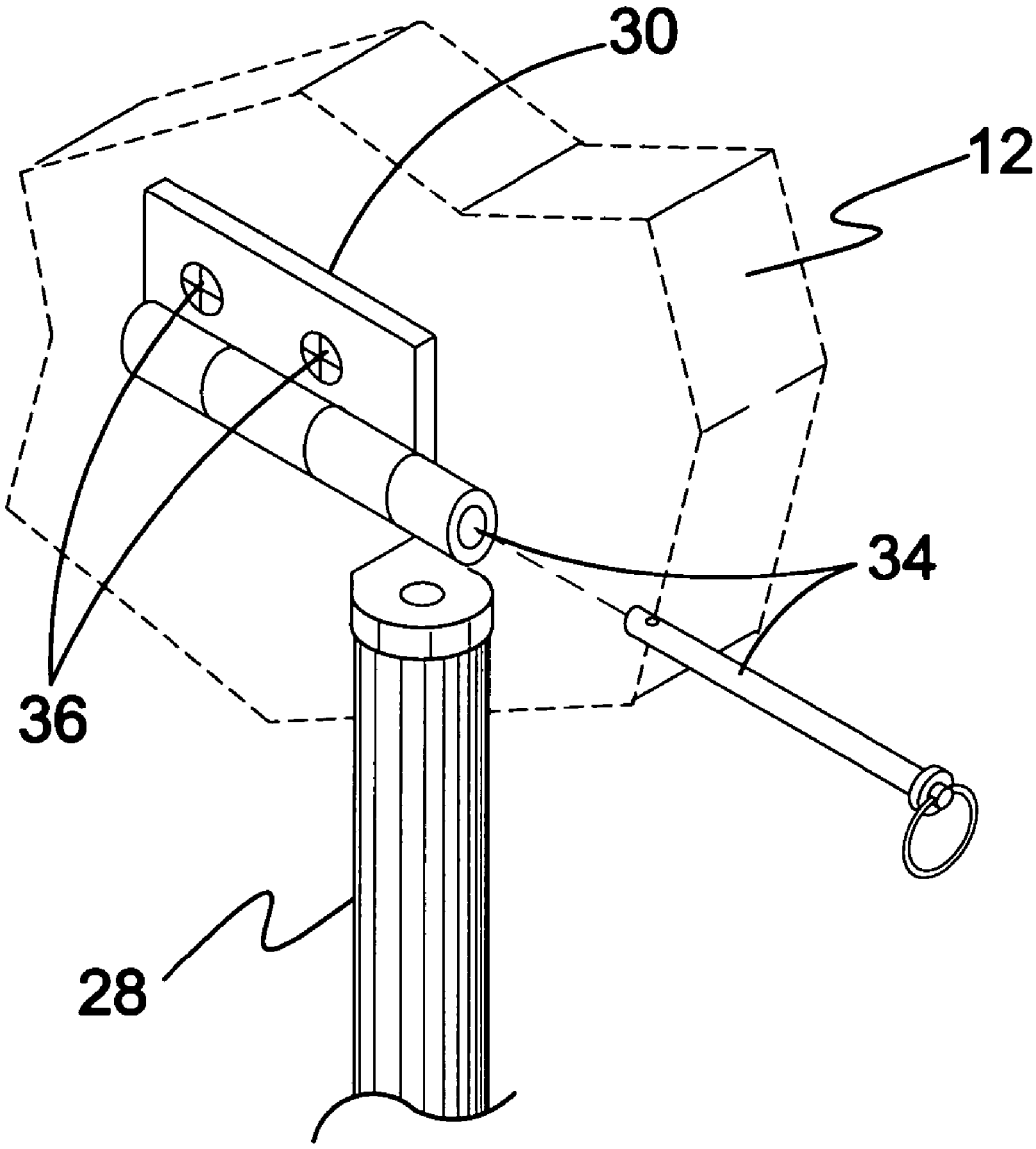
FIG. 8 is a perspective view of the toilet seat attachment of the pedal operated toilet seat lifter of the present invention.

FIG. 8 is a perspective view of a toilet seat attachment for the pedal operated toilet seat lifter of the present invention. For illustrative purposes, the toilet seat attachment 30 is shown as a single hinge attachment fastened to the under side of the toilet seat's 12 rear edge adjacent to the area where the toilet seat 12 is hingedly connected to the toilet bowl. While other hinge or pivotal fasteners will serve the same purpose, an object of the present invention to provide the user with means for easily detaching the apparatus 10 from toilet seat 12 when the need is determined by the user. The hitch pin 34 serves to attach the hinge 30 to the lifting member 28 whereby the seat lifter apparatus 10 may be detached solely by removing the hitch pin 34.

Figure 9:
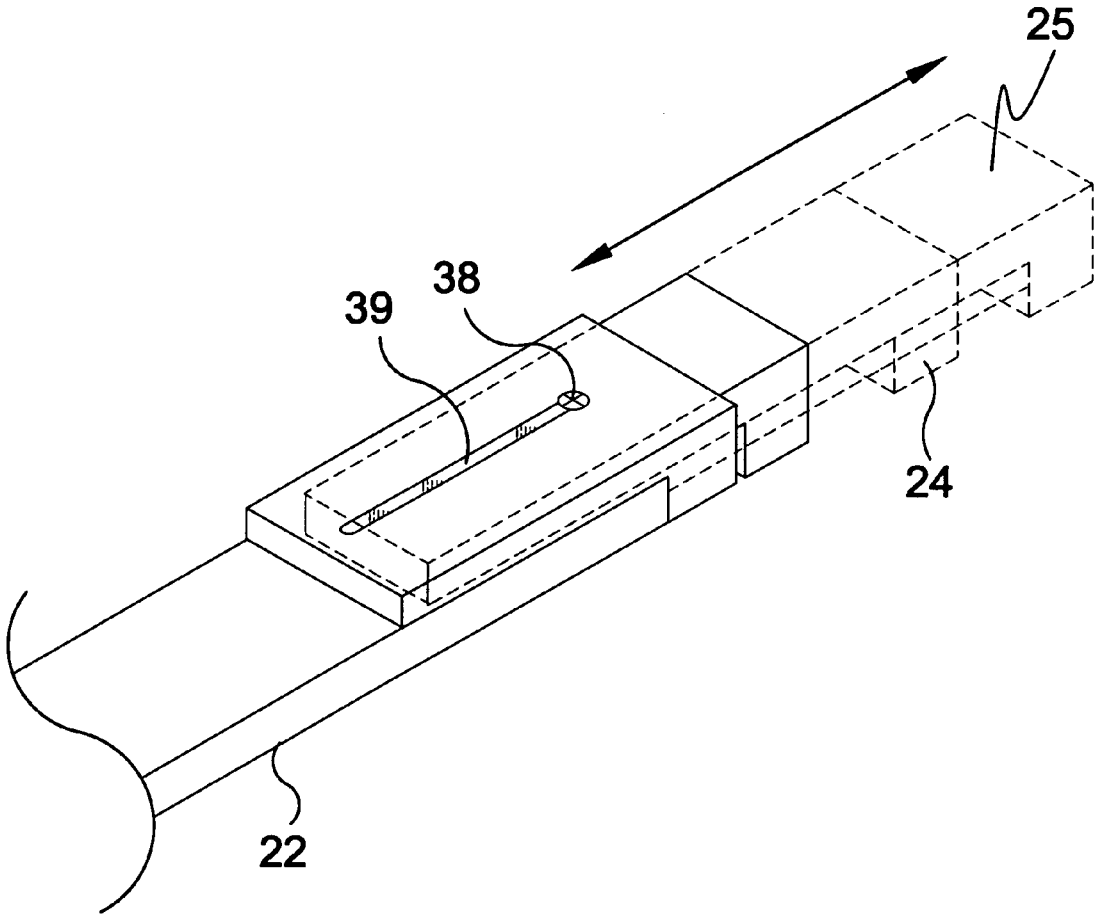
FIG. 9 is a perspective view of the adjustable wall brace of the pedal operated toilet seat lifter of the present invention.

FIG. 9 is a perspective view of an adjustable wall brace of the pedal operated toilet seat lifter of the present invention. The adjustable wall brace stabilizer 24 can be extended to abut structure, such as a wall to prevent casual displacement of the apparatus 10 during use. As shown herein, the stabilizer 24 includes a retractable member 25 and a track 39. The retractable member 25 is selectively moveable along a length of the track 39 thereby allowing the stabilizer to be selectively extendable from the base 22. The stabilizer is secured to at least one of the floor, the track and the wall by a tension screw 38. Upon extending the member 25 the desired distance, the tension screw 38 is secured thereby securing the base 22.

Figure 10:
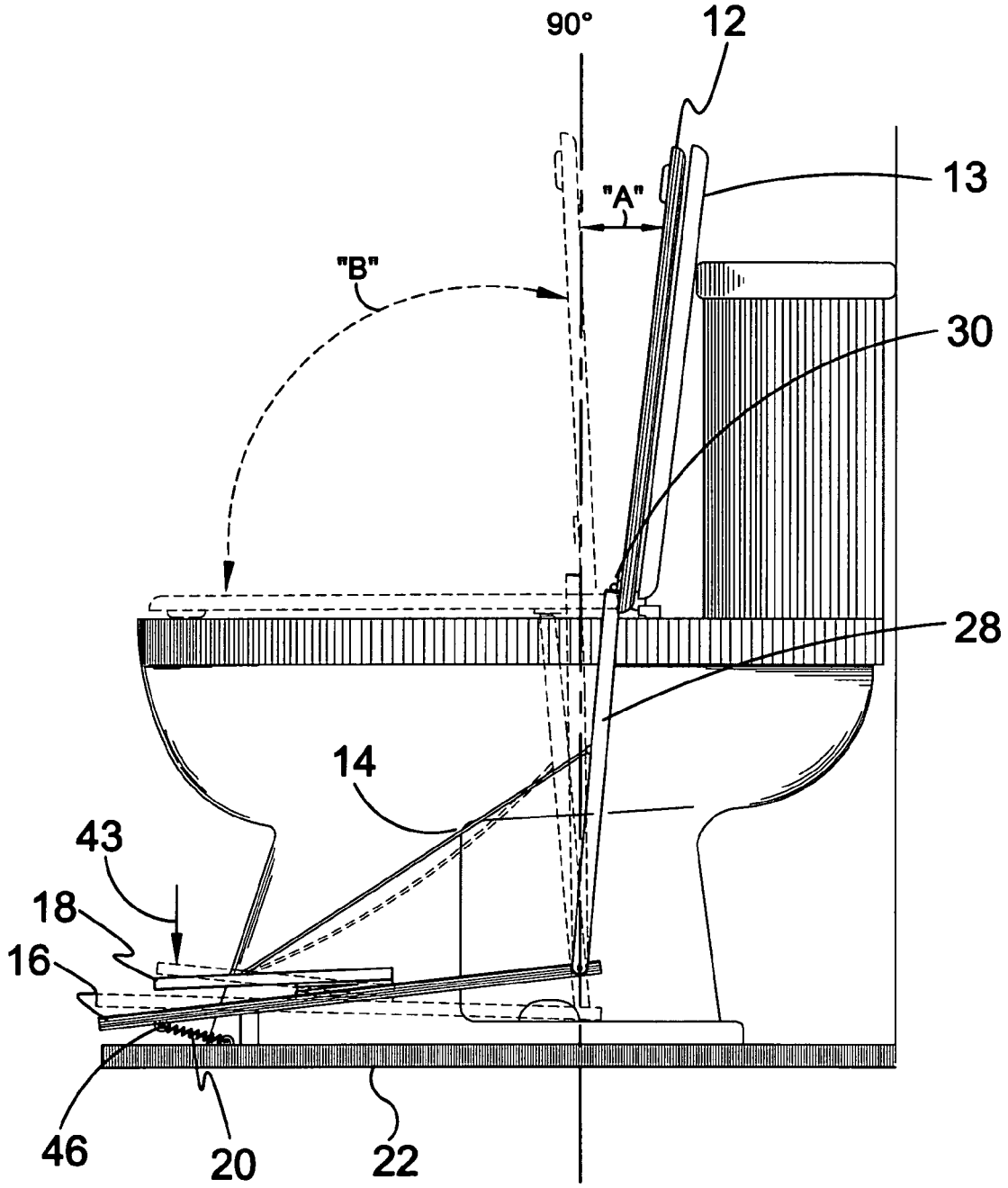
FIG. 10 is a perspective view of the pedal operated toilet seat lifter of the present invention incorporating a spring dampener.

FIG. 10 is a perspective view of the pedal operated toilet seat lifter of the present invention incorporating a dampener. The seat lifter apparatus 10 has a base 22 on which the apparatus 10 is anchored. The base 22 includes a pivot point 23 extending upward from a first side of the base 22. The pivot point 23 is located at a predetermined distance from a first edge of the base 22. A first foot pedal is pivotally mounted on the base 22 via the pivot point 23. A dampener 46, depicted as spring dampener 20, further connects the first foot pedal 16 to the base 22. The dampener 46 is connected between an underside of the first foot pedal 16 and the top side of the base 22. The dampener 46 is positioned at a predetermined point between the first edge and the pivot point 23. A lifting member 28 extends vertically from an edge of the first foot pedal 16 opposite the first edge and is connected thereto at a first end thereof by a connection pin 27. The lifting member 28 is connected to a toilet seat 12 via a toilet seat attachment 30 at an end opposite the connection with the first foot pedal 16.

A second foot pedal 18 is mounted either on the first foot pedal 16 via hinge 19 as shown or incorporated within foot pedal 16 as shown in FIGS. 6-7. A return linkage 14 is connected between a top side of the second foot pedal 18 and upper side of lifting member 28.

Shown herein, the toilet seat 12 is in the process of being lowered. A second downward force 43 is applied to the second foot pedal 18. The application of the force 43 causes the return linkage 14 to pull the lifting member 28 from an obtuse angle represented by distance "A" and "B" to an acute angle, represented by distance "B" relative to the toilet rim whereby gravity will cause the seat to lower. The toilet seat 12 is moved to a distance greater than or equal to the distance represented by the letter "A". When the toilet seat 12 has moved away from its at rest raised position, and is positioned past "A", an angle between the seat 12 and a rim of the toilet is less than 90 degrees, as shown herein, gravity causes the seat to move the remaining distance indicated by the letter "B" and the seat 12 is returned to a fully lowered position indicated by the dotted outline of the toilet seat 12. The dampener 46 slows the toilet seat's 12 descent to the bowl. The dampener 46 is a spring dampener 20 and additionally aids in raising the seat 12 as the spring dampener 20 is normally under tension when the seat 12 is in the lowered position. The lowering toilet seat 12 presses down on the lifting member 28 and returns the apparatus 10 to the neutral position.

Figure 11:
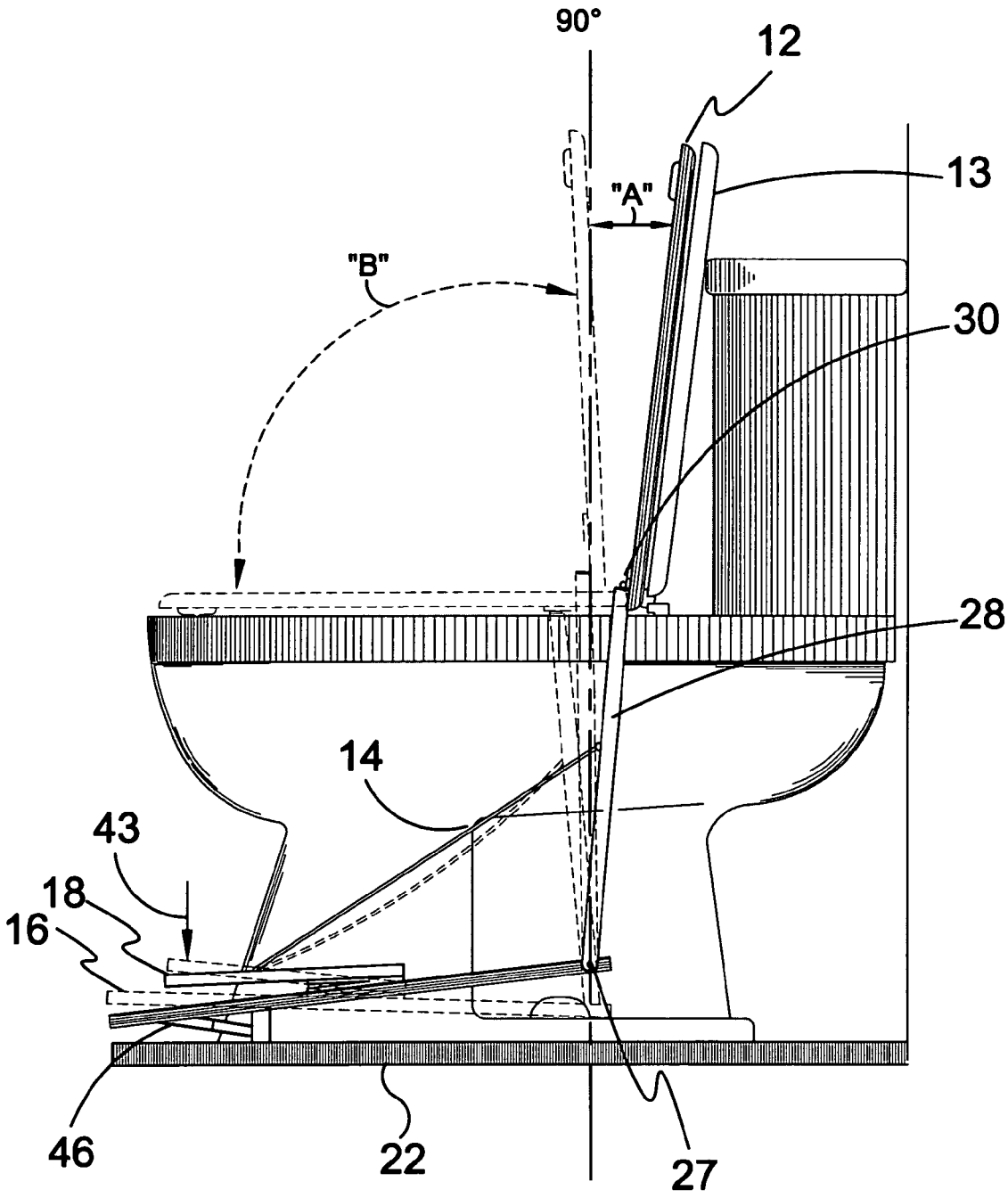
FIG. 11 is a perspective view of the pedal operated toilet seat lifter of the present invention incorporating an adjustable dampener.

FIG. 11 is a perspective view of the pedal operated toilet seat lifter of the present invention incorporating and adjustable dampener 46. The seat lifter apparatus 10 has a base 22 on which the apparatus 10 is anchored. The base 22 includes a pivot point 23 extending upward from a first side of the base 22. The pivot point 23 is located at a predetermined distance from a first edge of the base 22. A first foot pedal is pivotally mounted on the base 22 via the pivot point 23. A dampener 46 further connects the first foot pedal 16 to the base. The dampener 46 is connected between an underside of the first foot pedal 16 and the top side of the base 22. The dampener 46 is positioned at a predetermined point between the first edge and the pivot point 23. The dampener 46 described herein is an adjustable dampener 46 which is able to adjust the tension applied in slowing the movement of the toilet seat 12. A lifting member 28 extends vertically from an edge of the first foot pedal 16 opposite the first edge and is connected thereto at a first end thereof by a connection pin 27. The lifting member 28 is connected to a toilet seat 12 via a toilet seat attachment 30 at an end opposite the connection with the first foot pedal 16. In one embodiment, the toilet seat attachment 30 is a single hinge attachment and is provided on an under side of the toilet seat adjacent to a rear edge where the toilet seat 12 is hingedly connected to the rim of the toilet bowl as shown hereinafter in FIG. 5. The hinge attachment 30 may be connected using mounting screws 36 for wooden toilet seats 12 or epoxy for plastic toilet seats 12. A hitch pin 34 shown in FIG. 8 attaches the hinge to the lifting member 28 along with providing means for easily detaching apparatus 10 from toilet seat 12.

A second foot pedal 18 is mounted on the first foot pedal 16 via hinge 19 as shown in FIG. 3. A return linkage 14 is connected between a top side of the second foot pedal 18 and a midpoint of the lifting member 28.

Shown herein, the toilet seat 12 is in the process of being lowered. A second downward force 43 is applied to the second foot pedal 18. The application of the force 43 causes the return linkage 14 to pull the lifting member 28 from an obtuse angle represented by distance "A" and "B" to an acute angle, represented by distance "B" relative to the toilet rim whereby gravity will cause the seat to lower. The toilet seat 12 is moved to a distance greater than or equal to the distance represented by the letter "A". When the toilet seat 12 has moved away from its at rest raised position, and is positioned past "A", an angle between the seat 12 and a rim of the toilet is less than 90 degrees, as shown herein, gravity causes the seat to move the remaining distance indicated by the letter "B" and the seat 12 is returned to a fully lowered position indicated by the dotted outline of the toilet seat 12. The dampener 46 slows the toilet seat's 12 descent to the bowl. The dampener 46 as shown is an adjustable dampener providing means for the user to adjust the dampener as needed and aids in raising the seat 12 as the dampener 46 is normally under tension when the seat 12 is in the lowered position. The lowering toilet seat 12 presses down on the lifting member 28 and returns the apparatus 10 to the neutral position.

Figure 12:
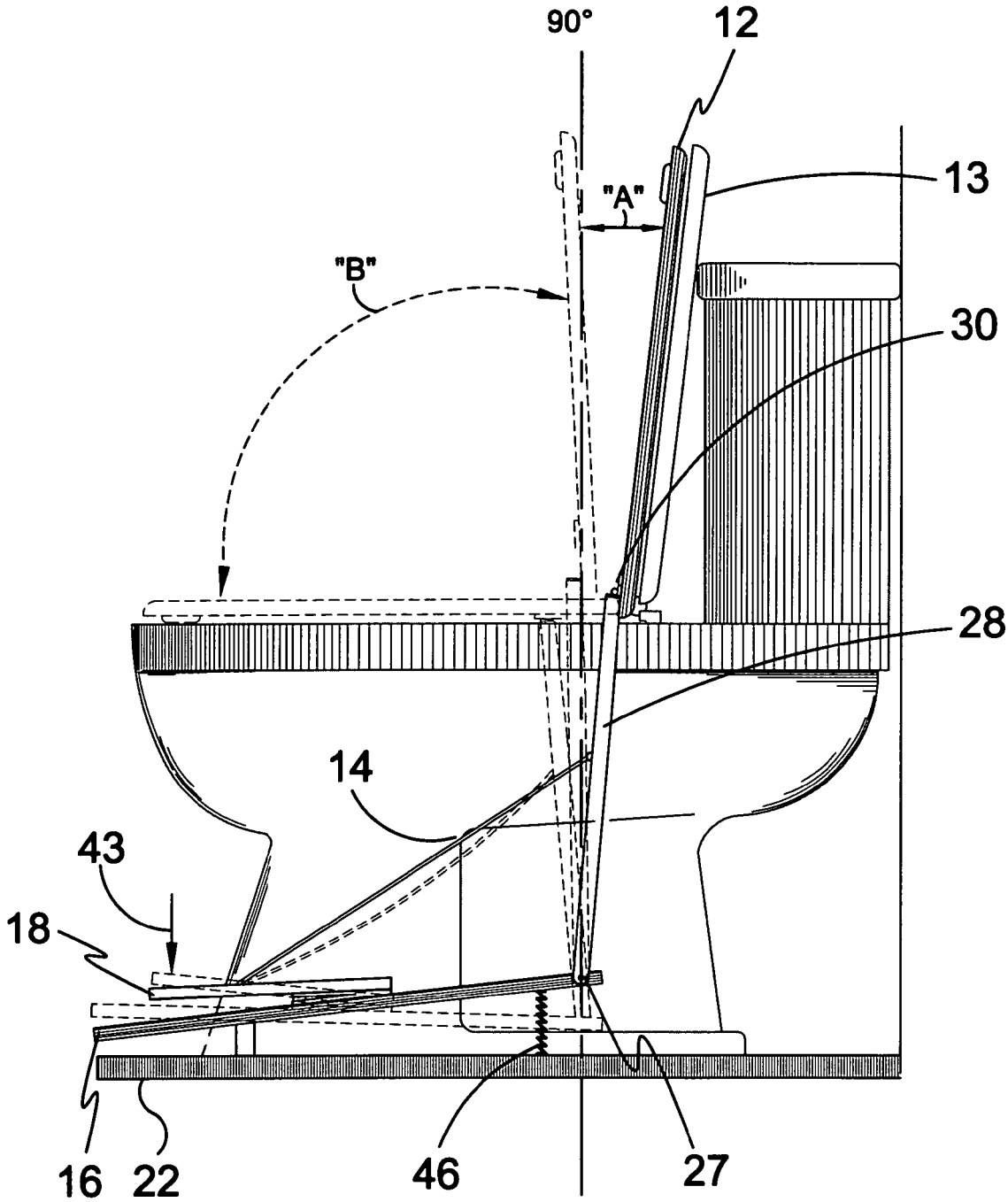
FIG. 12 is a perspective view of the pedal operated toilet seat lifter of the present invention incorporating an alternate dampener.

FIG. 12 is a perspective view of the pedal operated toilet seat lifter of the present invention incorporating an alternate dampener 46. The seat lifter apparatus 10 has a base 22 on which the apparatus 10 is anchored. The base 22 includes a pivot point 23 extending upward from a first side of the base 22. The pivot point 23 is located at a predetermined distance from a first edge of the base 22. A first foot pedal is pivotally mounted on the base 22 via the pivot point 23. A dampener 46 further connects the first foot pedal 16 to the base. The dampener 46 is connected between an underside of the first foot pedal 16 and the top side of the base 22. The dampener 46 is positioned at a predetermined point between the pivot point 23 and the edge of the base opposite the first edge. The dampener 46 described herein is an adjustable dampener 46 which is able to adjust the tension applied in slowing the movement of the toilet seat 12. A lifting member 28 extends vertically from an edge of the first foot pedal 16 opposite the first edge and is connected thereto at a first end thereof by a connection pin 27. The lifting member 28 is connected to a toilet seat 12 via a toilet seat attachment 30 at an end opposite the connection with the first foot pedal 16.

Shown herein, the toilet seat 12 is in the process of being lowered. A second downward force 43 is applied to the second foot pedal 18. The application of the force 43 causes the return linkage 14 to pull the lifting member 28 from an obtuse angle represented by distance "A" and "B" to an acute angle, represented by distance "B" relative to the toilet rim whereby gravity will cause the seat to lower. The toilet seat 12 is moved to a distance greater than or equal to the distance represented by the letter "A". When the toilet seat 12 has moved away from its at rest raised position, and is positioned past "A", an angle between the seat 12 and a rim of the toilet is less than 90 degrees, as shown herein, gravity causes the seat to move the remaining distance indicated by the letter "B" and the seat 12 is returned to a fully lowered position indicated by the dotted outline of the toilet seat 12. The dampener 46 slows the toilet seat's 12 descent to the bowl. The dampener 46 aids in raising the seat 12 as the dampener 46 is normally under tension when the seat 12 is in the lowered position. The lowering toilet seat 12 presses down on the lifting member 28 and returns the apparatus 10 to the neutral position.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An apparatus for selectively moving a toilet seat between a first and second position comprising:

a) a base;

b) a first pedal having a first end for receiving a downward force thereon, said first pedal having opposed upper and lower surfaces, said first pedal being pivotally connected to said base via said lower surface;

c) first means for connection between the toilet seat and an end of said first pedal opposite said first end for moving the toilet seat from a first position to a second position;

d) a second pedal having opposed upper and lower surfaces and a first end for receiving a downward force thereon, said second pedal having a second end opposite said first end, said second pedal being pivotally connected to the upper surface of said first pedal adjacent the second end of said second pedal; and e) a non-rigid return member connected between said second pedal and upper end of said first moving means for moving the toilet seat from the second position to the first position and said second pedal away from said first pedal; wherein said non-rigid return member is connected to the said upper surface of said second pedal intermediate said first and second ends of said second pedal; wherein upon applying the downward force to the first end of the first pedal, the first pedal pivots and causes the first moving means to move the toilet seat from the first position to the second position and causes the non-rigid return member to move the second pedal away from the first pedal, wherein upon applying the downward force on said first end of the second pedal, the second moving means causes the toilet seat to be moved from the second position to the first position.

2. The apparatus as recited in claim 1, further comprising an engagement member for connecting said first moving means to the toilet seat.

3. The apparatus as recited in claim 2, wherein said engagement member is a hinge adapted to be secured to the toilet seat and a first end of said moving means.

4. The apparatus as recited in claim 3, wherein said hinge is adapted to be connected to the toilet seat by at least one of a plurality of screws, nails, adhesive and epoxy glue.

5. The apparatus as recited in claim 1, wherein said first pedal is a lever able to actuate said first moving means for causing said toilet seat to be moved from said first position to said second position.

6. The apparatus as recited in claim 5, wherein said first pedal is pivotally fastened to said base through a lever fulcrum.

7. The apparatus as recited in claim 6, wherein said lever fulcrum forms an integral part of said base.

8. The apparatus as recited in claim 5, wherein upon actuating said first moving means, an angle measuring greater than 90 degrees is formed at a point of connection between said first pedal and said first moving means.

9. The apparatus as recited in claim 1, further comprising a pivotal fastener connected between said first and second pedals for maintaining a predetermined position upon application of said downward force on said first end of said first pedal.

10. The apparatus as recited in claim 1, said non-rigid return member and-includes slack when the toilet seat is in said first position.

11. The apparatus as recited in claim 1, said non-rigid return member and is taut when the toilet seat is in said second position.

12. The apparatus as recited in claim 11, wherein upon applying said downward force on said first end of said second moving means, said second moving means causes the toilet seat to move towards the first position.

13. The apparatus as recited in claim 12, wherein said base further comprises a track and a securing member is retractable and selectively moveable along a length of said track.

14. The apparatus as recited in claim 1, further comprising a dampening member for reducing the speed at which the toilet seat moves from at least one said first position to said second position and from said second position to said first position.

15. The apparatus as recited in claim 14, wherein said dampening member is selectively adjustable allowing a user to determine a force to be used in slowing the speed of the toilet seat.

16. The apparatus as recited in claim 14, wherein said dampening member assists in raising said first moving means when a force is applied to said first pedal.

17. The apparatus as recited in claim 14, wherein said dampening member is connected between said base and an underside of said first pedal proximate said first end of said first pedal.

18. The apparatus as recited in claim 14, wherein said dampening member is connected between said base and an underside of said first pedal proximate to the end at which said first pedal is connected to said first moving means.

* * * * *